US006173845B1

(12) United States Patent
Higgins et al.

(10) Patent No.: US 6,173,845 B1
(45) Date of Patent: Jan. 16, 2001

(54) BEVERAGE DISPLAY RACK WITH HEAD LOCKING KEYWAY

(75) Inventors: Mark A. Higgins, Duluth; James David Robertson, Atlanta; James Douglas Whiten, Kennesaw, all of GA (US)

(73) Assignee: Display Industries, LLC., Smyrna, GA (US)

( * ) Notice: Under 35 U.S.C. 154(b), the term of this patent shall be extended for 0 days.

(21) Appl. No.: 09/332,464

(22) Filed: Jun. 14, 1999

(51) Int. Cl.[7] ..... A47B 73/00

(52) U.S. Cl. ..... 211/74; 211/181.1; 248/175

(58) Field of Search ..... 211/74.75, 71.01, 211/181.1, 85.18, 85.31, 85.29, 106, 119, 59.2; 248/153, 175; D6/566, 462–465, 458; D7/701, 704

(56) References Cited

U.S. PATENT DOCUMENTS

| | | | | |
|---|---|---|---|---|
| D. 30,331 | * | 3/1899 | Walker | D6/458 |
| D. 111,736 | * | 10/1938 | De Sbato | D7/701 |
| D. 117,252 | * | 10/1939 | Bambanek et al. | D6/458 |
| D. 180,883 | * | 8/1957 | Perry | D6/462 |
| D. 216,690 | * | 3/1970 | Robak | D6/462 |
| D. 232,205 | * | 7/1974 | Kaner | D6/463 |
| D. 247,532 | * | 3/1978 | Tenney | 211/181.1 X |
| D. 305,187 | * | 12/1989 | Kaufman, Jr. | D6/463 |
| D. 409,056 | * | 5/1999 | Olson et al. | D7/704 |
| 3,003,644 | * | 10/1961 | Hilderbrand | 211/74 |
| 3,477,585 | * | 11/1969 | Adams | 211/106 |
| 4,106,736 | * | 8/1978 | Becker, III et al. | 211/106 |
| 4,318,485 | | 3/1982 | Clement | 211/49 D |
| 4,367,818 | | 1/1983 | Suttles | 211/49 D |
| 4,401,221 | | 8/1983 | Suttles | 211/49 D |
| 4,558,647 | * | 12/1985 | Petersen | 211/181.1 |
| 4,620,489 | * | 11/1986 | Albano | 211/181.1 |
| 4,998,631 | * | 3/1991 | Fridjhon | 211/74 |
| 5,215,199 | * | 6/1993 | Bejarno | 211/74 |
| 5,586,687 | | 12/1996 | Spamer et al. | 221/298 |
| 5,695,074 | | 12/1997 | Wiese | 211/59.2 |
| 5,695,075 | | 12/1997 | Flum et al. | 211/59.2 |
| 5,718,341 | | 2/1998 | Robertson | 211/59.2 |
| 5,755,341 | | 5/1998 | Spamer | 211/59.2 |
| 5,785,189 | * | 7/1998 | Gollob et al. | 211/74 |
| 5,826,731 | * | 10/1998 | Dardashti | 211/74 |
| 5,865,326 | * | 2/1999 | Spamer et al. | 211/181.1 |

FOREIGN PATENT DOCUMENTS

| | | | | |
|---|---|---|---|---|
| 61966 | * | 2/1864 | (FR) | 211/74 |
| 78019 | * | 10/1867 | (FR) | 211/74 |
| 127447 | * | 11/1878 | (FR) | 211/74 |
| 2333469 | * | 7/1977 | (FR) | 211/74 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

A display rack for displaying all sizes of beverage bottles has a bottom, laterally extending cross member, a top, laterally extending cross member spaced from and above the bottom cross member, and vertical support members for supporting the top and bottom cross members. The top cross member has at least one keyway for receiving the head of a beverage bottle and holding the beverage bottle. The keyway limits upward movement of the bottle the associated bottom cross member limits downward movement of the bottle.

18 Claims, 10 Drawing Sheets

BEVERAGE DISPLAY RACK WITH HEAD LOCKING KEYWAY

FIELD OF THE INVENTION

The present invention relates generally to display racks, and, more particularly, to a display rack for displaying bottles of beverage especially two and three liter bottles.

BACKGROUND OF THE INVENTION

Merchandising display racks are not only used to shelve items awaiting purchase by a consumer so that the items are available, but are also used to arrange available items attractively and make them easy to recognize. There is intense competition for shelf space. In the beverage industry there is fierce competition so that making available items attractive and easy to recognize is crucial. A merchandising display rack can maximize shelf space while minimizing floor space allowing a retailer to stock more of the items consumers demand as well as stock more brands of competing products, particularly beverages.

Bottle beverages in the large two and three liter container sizes present a challenge. Conventional racks position the bottles either vertically or horizontally. When positioned horizontally, the horizontal rows must be spaced apart a sufficient distance to view the labels otherwise only the top row or eye level row of labels is visible. When positioned vertically, more product visibility is achieved but more precious floor space must be used to achieve the same shelf space as horizontal positioning. While racks can be made to reach the ceiling, ceiling high racks are not practical because a consumer would need a ladder to reach the top shelf. Accordingly, it will be appreciated that it would be highly desirable to have a display rack that combines the visibility of vertical racks with the product density of horizontal racks while using the floor space of compact vertical racks.

With any self-service shelving system a very important consideration, if not the most important, is the ease with the consumer can retrieve the desired product from the shelf. While products at eye level are perhaps the easiest to view on a shelf, those placed lower at elbow level are easiest to retrieve. It is therefore desirable to have a merchandising display rack for large beverage bottles that promotes bottle retrieval from elbow level.

SUMMARY OF THE INVENTION

Briefly summarized, according to one aspect of the present invention, a display rack has a bottom cross member, a top cross member spaced from the bottom cross member with the top cross member having at least one keyway for receiving a head of a beverage bottle; and support means for supporting the top and bottom cross members and vertically positioning the cross members. The keyway engages the bottle to hold the bottle at an angle thereby achieving greater bottle density than vertically stacking bottles while achieving greater bottle label exposure than horizontally stacking bottles.

According to another aspect of the invention, a display rack for holding a plurality of beverage bottle has an upright panel with a plurality of keyways wherein each keyway receives a head of said beverage bottle, and support means for supporting the upright panel and vertically positioning the keyways. Bottles can be inserted and removed from either side of the panel. The keyway accommodates a variety of sizes of bottles.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
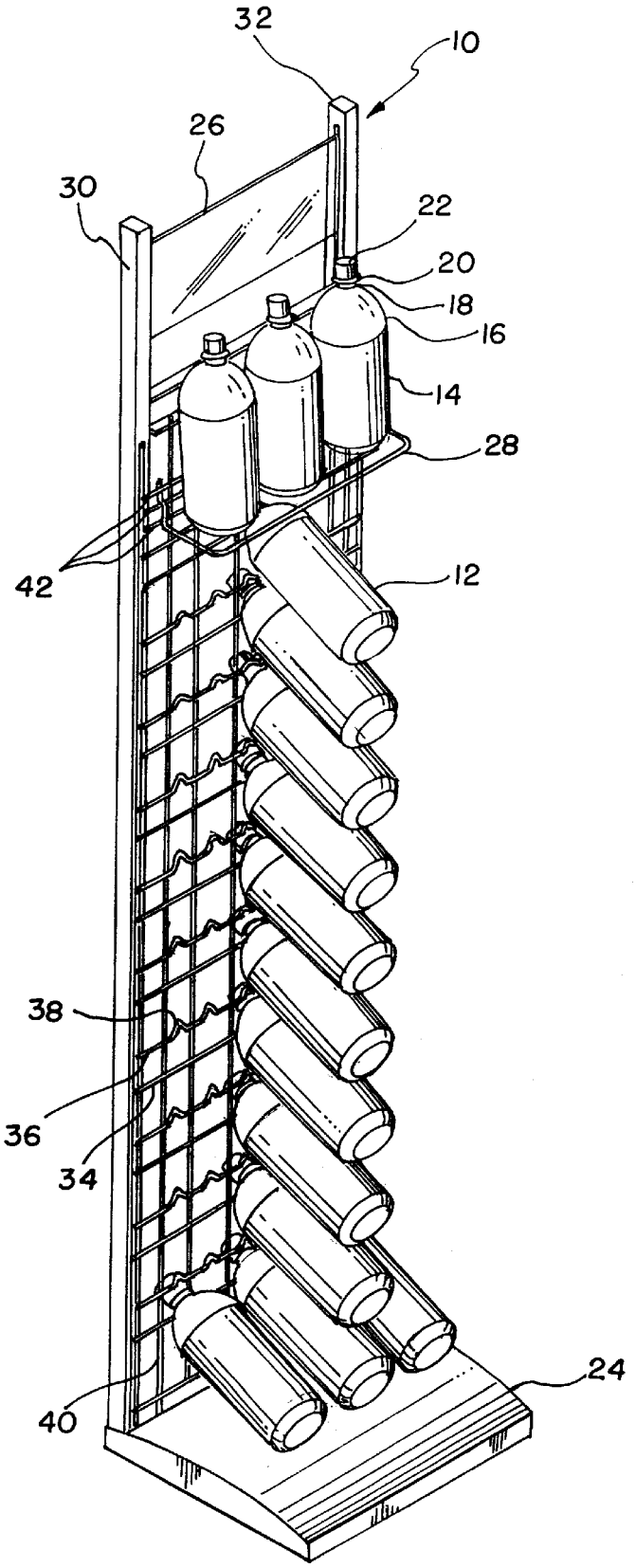
FIG. 1 is a diagrammatic perspective view of a preferred embodiment of a beverage display rack engaging heads of beverage bottles according to the present invention.

FIG. 1 illustrates a display rack 10 according to the present invention for holding a plurality of beverage bottles 12 of the two and three liter variety. Each beverage bottle 12 has a body 14, a shoulder 16 sitting atop the body, a neck 18 atop the shoulder, a protruding ring 20 about the neck, and a head 22 atop the neck. Display rack 10 can be used for both glass and plastic bottles.

The display rack 10 is mounted on a support base 24 which established the footprint for the display rack 10. The rack illustrated is less than seven feet tall including the decal sign 26 at the top, and is less than 18 inches wide but can easily hold 33 two-liter bottles on its front including the three bottles sitting on a horizontal shelf 28. The number of bottles is increased by 20 when bottles are engaged from the rear of the display. By increasing the width of the display a mere four inches, ten additional bottles can be accommodated. The display rack 10 can easily be positioned at the end of an aisle because it would extend the aisle length less than two feet and provide access to beverages from either side of the aisle. The front to rear dimension if base 24 is less than the height of the beverage bottle it holds. Where it is desired to mount the display on a wall or end of a shelf aisle, the base is not required; the rack can be mounted using clamps, hooks, bolts or other fasteners.

Figure 2:
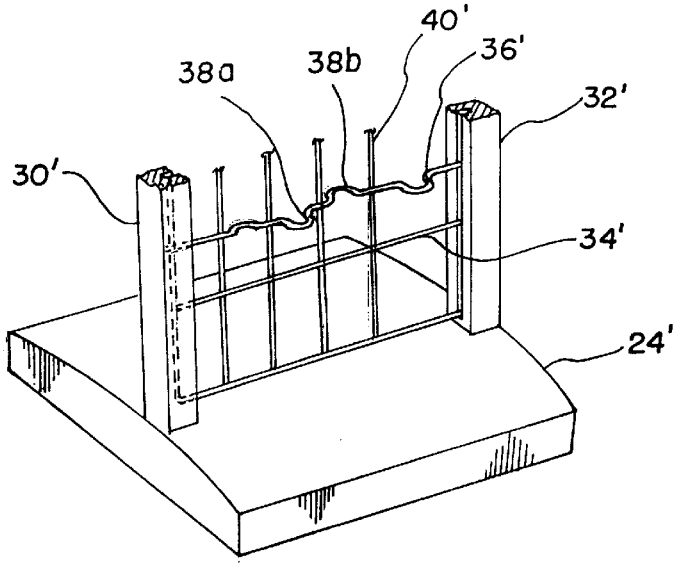
FIG. 2 is a partial perspective view of another embodiment of a base platform for the display rack of FIG. 1.

The display rack 10 includes a left upright 30 that is attached to the support base 24. Left upright member 30 has front, rear, left and right vertical surfaces, with the right vertical surface preferably defining a longitudinal groove. Similarly a right upright 32 is spaced from the left upright member 30 and is also attached to the base. Right upright member 32 has front, rear, left and right vertical surface with the left vertical surface preferably defining a longitudinal groove that faces the longitudinal groove of the left upright member 30. The decal holder 26 is preferably fitted in the longitudinal grooves at the top of the display. The preferred material for the members of the display rack is steel, but aluminum or plastic could also be used. Upright members 30, 32 are preferably attached to the supporting base 24 by welding or the like but other fastening methods could be used. Upright members 30, 32 are attached along one edge of the support base 24 but could be attached near the mid section of the supporting base (FIG. 2). When the uprights are attached along an edge of the base, the display rack may be positioned against a wall or at the end of a store shelf for a flush fit. On the other hand, where bottles will extend from both the front and rear of the display rack, then it is preferred to connect the uprights near the mid section of the base for best lateral stability of the display unit.

A grid is provided for holding the bottles in the display rack at an angle which makes a more attractive display. The grid includes a plurality of bottom cross members 34 that extend laterally between the left and right upright members 30, 32. The bottom cross members are vertically spaced from one another and extend from the bottom of the unit to the top of the unit at spaced intervals. The bottom cross member is spaced from the supporting base 24 a distance sufficient to allow clearance between the base and the bottle when the bottle is positioned in the display rack and hangs down at an angle. A plurality of top cross members 36 are spaced from one another and extend laterally between the left and right upright members parallel to the bottom cross members 34. Each top cross member has one or more keyways 38 which receive the head of the beverage bottle. The rack also contains a plurality of vertical members 40 with each vertical member being spaced from a keyway and positioned adjacent a keyway to limit lateral movement of a bottle in the keyway.

Figure 4:
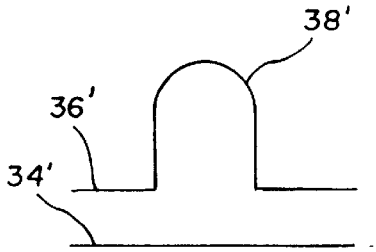
FIGS. 4–7 illustrate alternate configurations for the bottle holding members of the display rack of FIG. 1.
Figure 5:
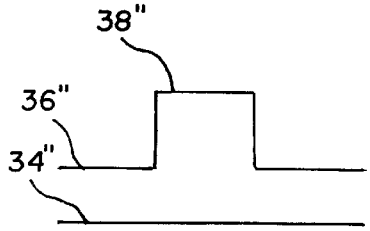
Figure 6:
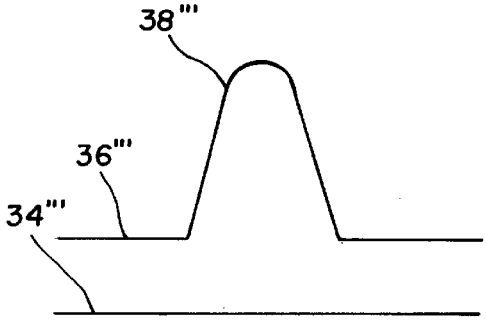

FIG. 4 illustrates the relationship between a bottom cross member 34' and its associated upper cross member 36' with its keyway 38' having a rounded portion to exactly fit the neck of a bottle. Similarly, FIG. 5 illustrates a bottom cross member 34" with its associated top cross member 36" and keyway 38" in the shape of a simple rectangle. FIG. 6 illustrates a bottom cross member 34" with its associated top cross member 36'"and keyway 38'"which has a conical shape with the tip of the cone rounded off.

Figure 3:
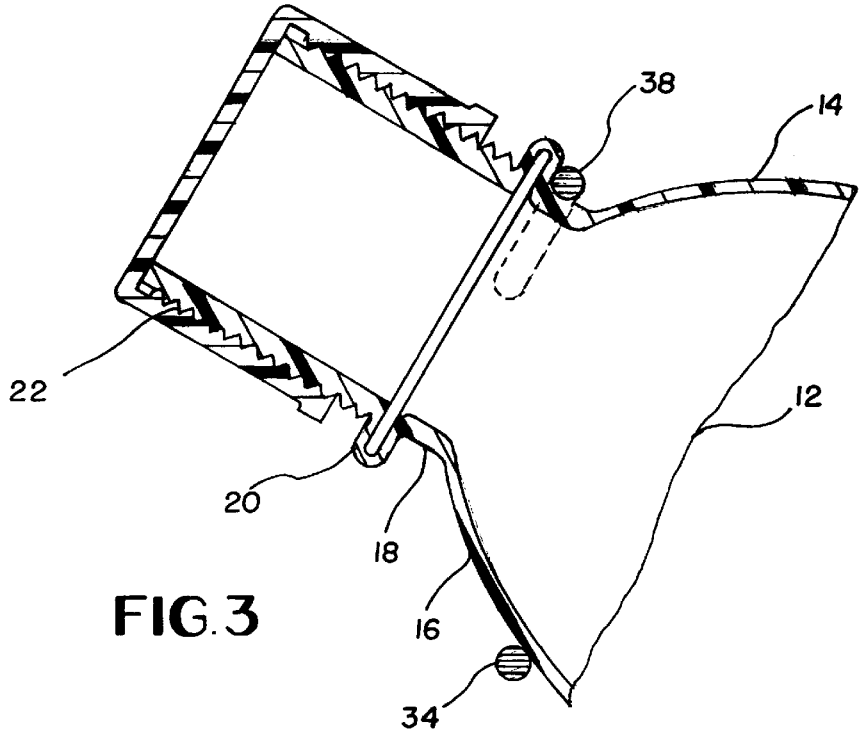
FIG. 3 is a longitudinal sectional view taken lengthwise through a beverage bottle illustrating contact between the beverage bottle and the holding members of the display rack of FIG. 1.

FIG. 3 more clearly illustrates the relationship between the cross members and the bottle. As illustrated the head 22 of the bottle is inserted in keyway 38 above bottom cross member 34 so that keyway 38 engages the neck 18 of the bottle thereby limiting upward movement of the neck of the bottle 12. Shoulder 16 is supported on bottom cross member 34 as bottle 12 angles downward with the body 14 lower than head 22. The weight of the body and its contents creates a force tending to pivot the bottle about lower cross member 34 but the pivotal motion is stopped by the uppermost portion of keyway 38. The bottle remains suspended on the rack until it is removed by a consumer who removes it by lifting upward on the body and sliding the neck downward to disengage it from the keyway. When disengaged from the keyway, the bottle is pulled toward the consumer to free it from the rack. As stock in the rack is diminished, the rack can be completely restocked or the available bottles on the rack can be rearranged to put them in the middle portion of the rack for greater accessibility by the majority of the consuming public.

Figure 19:
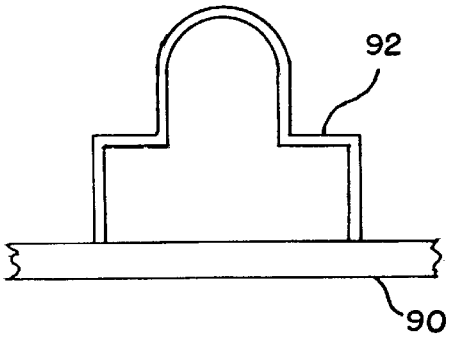
FIG. 19 is a diagram illustrating bottle holding members for the lower tiers of the display rack of FIG. 18.
Figure 20:
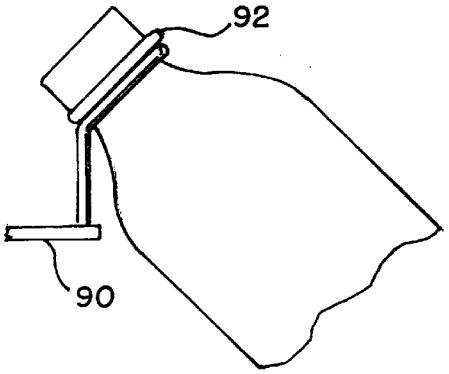
FIG. 20 is a diagram illustrating bottle holding members for the top tier of the display rack of FIG. 19.
Figure 21:
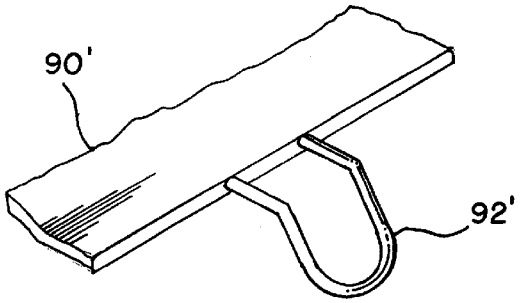
FIG. 21 is a diagrammatic perspective view of a keyway similar to FIGS. 19 and 20 but illustrating another embodiment.
Figure 18:
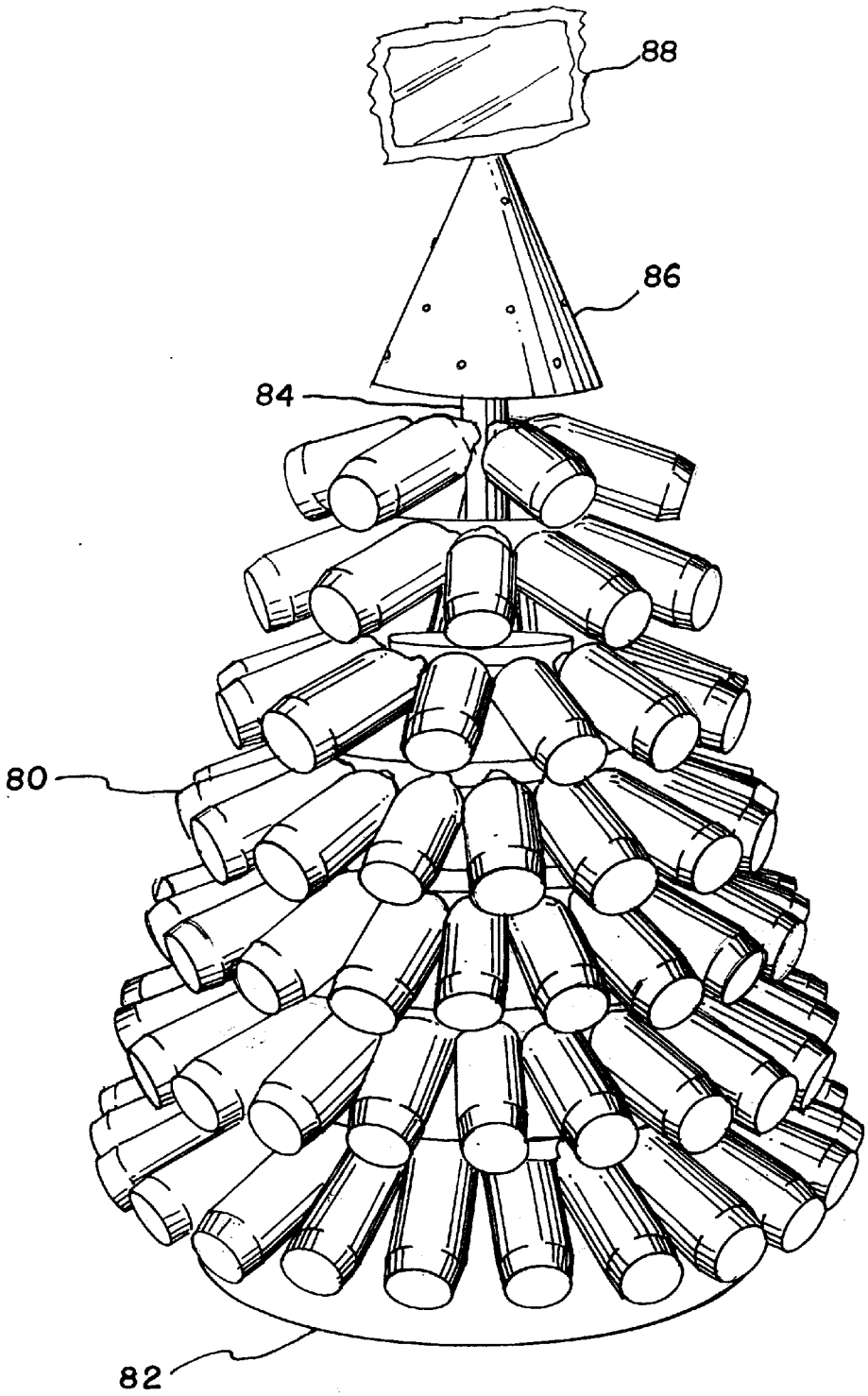
FIG. 18 is display rack employing bottle holding elements to hold beverage bottles in a conical configuration to simulate a holiday tree.

Support from the bottom cross member is not required where the keyway is angled and the bottle is held by the neck ring engaging the keyway (see FIGS. 19–21). The downward force of the bottle urges the bottle neck against the keyway and the neck ring with sufficient force to prevent the bottle from slipping out of the keyway. The bottle's own weight helps hold it in position. Support from the bottom cross member is not required, but such support is preferred because it protects against inadvertent dislodging of a bottle.

Referring now to FIG. 2 which illustrates an alternate embodiment of the display rack, left and right upright members 30', 32' are attached to the supporting base 24' near its mid section. Lower and upper cross members 34', 36' extend laterally between the upright members and are seated in the longitudinal grooves in the upright members. Seating the cross members in the grooves not only hides the ends of the wire members but also minimizes the opportunity to snag clothes on the rack. Upper cross member 36' contains keyways **38*a*, 38*b* that are oriented to receive bottles from different directions. Keyways 38*a* receive bottles from the rear of the display rack while keyways 38*b*** receive bottles from the front of the rack. This construction provides the advantage of a freestanding display rack that can be placed at any location. It should be noted that the display rack can be mounted directly to a floor without the supporting base when suitable anchors are used.

Again referring to FIG. 1, the adjustable horizontal shelf 28 can be attached directly to the upright members 30, 32, the vertical members 40, or additional cross members can be provided to support shelf 28. Preferably, additional cross members 42 are provided to support the shelf. One arrangement is to have three additional cross members 42 with the shelf 28 constructed of wire with mounting flanges that interweave the cross members to support the shelf. Additional cross members 42 can be placed at any height to position the shelf at any height along the rack.

Figure 8:
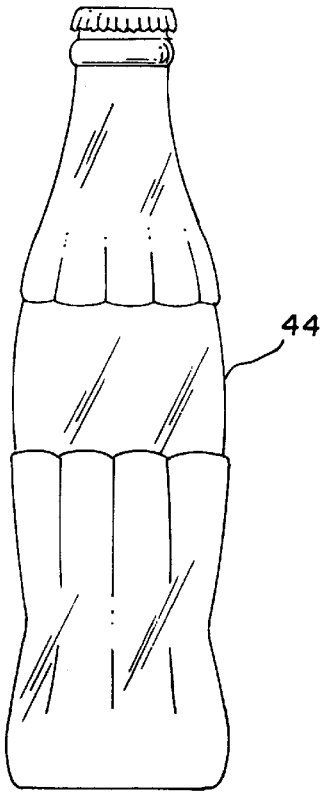
FIG. 8 is a side panel for the display rack of FIG. 1 shown configured as a familiar beverage bottle for attachment to either side of the display rack.

Referring now to FIGS. 1 and 8, a side panel 44 is illustrated configured as a familiar beverage bottle for attaching to the left upright member 30 or the right upright member 32. Where both sides of the rack will be visible, a side panel 44 is attached to either side of the rack. When the side panel 44 is contoured and decorated to simulate a familiar beverage bottle it makes the display easily recognizable, even from across a store because it is on the order of seven feet tall.

Figure 7:
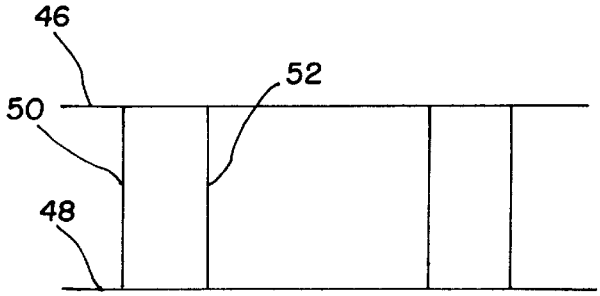

FIG. 7 illustrates another configuration for the cross members and the intersecting vertical members. In this illustration the top and bottom cross members 46, 48 are both straight without a loop for a keyway. A first vertical member 50 extends vertically between the top and bottom cross members 46, 48 while a second vertical member 52 runs parallel to first vertical member 50. The lateral spacing between vertical members 50 and 52 is sufficient to allow the head of the bottle to pass between them with the neck ring engaging upper cross member 46 from the rear while the shoulder of the bottle rests on bottom cross member 48 to suspend the beverage bottle at an angle. The absence of a formal keyway makes the cross members easier to manufacture; however, a formal keyway is preferred because the keyway conforms more closely to the configuration of the neck to provide greater holding power to prevent inadvertent dislodging of a bottle.

It can now be appreciated that the merchandise and display rack maximizes shelf space while minimizing floor space. The rack displays beverage bottles at an angle which combines the visibility of a vertical rack with the product density of a horizontal rack while using the floor space of a compact vertical rack. For finicky consumers, the rack also provides an opportunity for the consumer to view each product available and to select any product viewed with equal ease.

Figure 9:
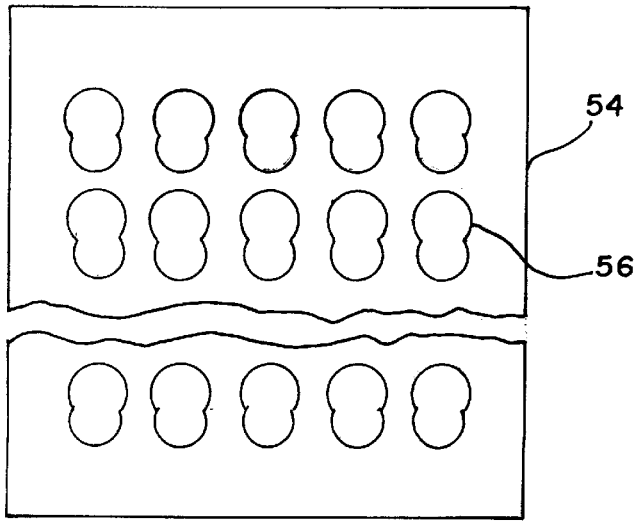
FIG. 9 is a front view of a display panel featuring keyholes for the display rack of FIG. 1.
Figure 10:
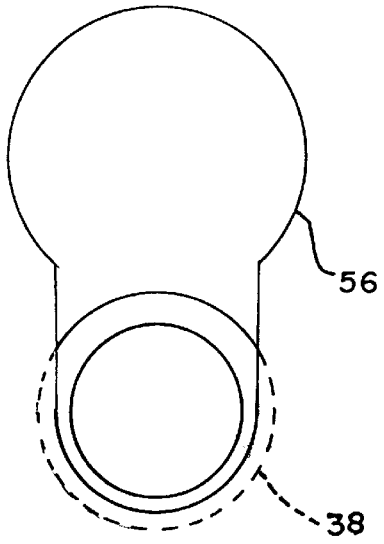
FIG. 10 is a somewhat enlarged view of one of the keyholes of FIG. 9.

Referring to FIGS. 1, 9 and 10, the display rack may be fitted with a single panel 54 having a plurality of keyways 56 instead of a grid structure. Panel 54 would slide down the longitudinal grooves of the upright members 30, 32. Each keyway receives the head and neck ring of a bottle and engages the head to limit upward movement of the head while allowing the body to tilt downward a prescribed amount. The keyway 56 actually abuts the neck ring 38' to retain the bottle on the rack. Beverage bottles can be inserted from either the front or the rear of the flat panel for access to the beverages from both sides of the display rack. As illustrated in FIG. 10, the keyway 56 will accommodate both the two liter bottle and the three liter bottle. A three-liter bottle is inserted through the larger portion of the keyway and is allowed to tilt downward with the upper portion of the keyway engaging the neck of the three-liter bottle. When it is desired to remove the three-liter bottle, the body of the bottle is raised upward to disengage its neck from the keyway and pulled toward the consumer to remove it from the keyway. Similarly, a two-liter bottle is inserted through the larger portion of the keyway and slid down into the smaller portion until its neck engages the bottom of the keyway. The body of the bottle is then allowed to tilt downward a preselected amount. When the desired tilt is obtained, the bottle is pulled forward causing the neck ring to engage the rear of the keyway which holds the bottle in position until it is removed. The two-liter bottle is removed by lifting the body of the bottle upward to disengage the neck from the keyway. It is then slid up to the larger portion of the keyway and pulled forward toward the consumer to remove it from the keyway.

Figure 11:
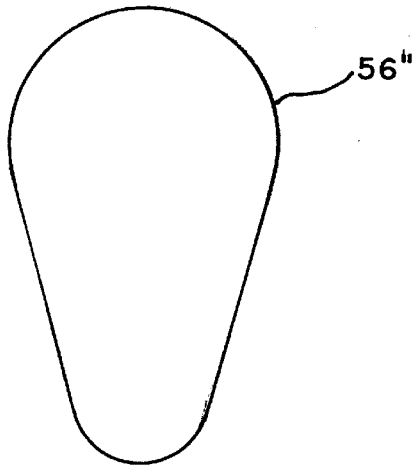
FIG. 11 is a view similar to FIG. 10 but illustrating another embodiment of a keyway.

FIG. 11 illustrates another embodiment of a keyway. Keyway 56" accommodates a variety of bottle sizes, not solely two liter and three liter bottles. Keyway 56" has an inverted pear shape with larger bottles engaging the larger upper portion of the keyway and smaller bottles engaging the smaller lower portion of the keyway. Intermediate sized bottles engage the middle portion of the keyway instead of the ends.

Figure 12:
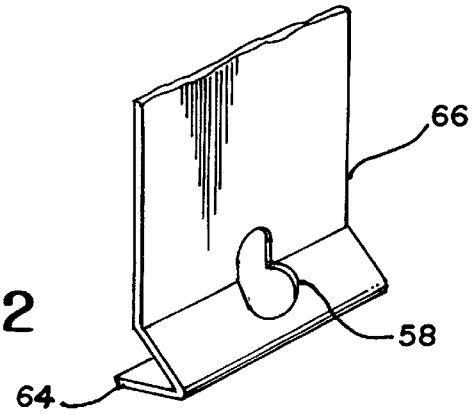
FIG. 12 is a front view of a bottle holding member featuring a keyhole configuration for engaging the head of a bottle.
Figure 13:
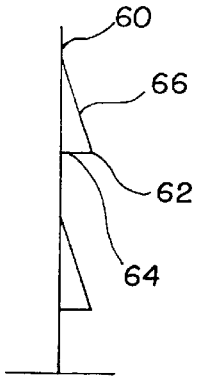
FIG. 13 is a side view of a display rack featuring the bottle holding members of FIG. 12 arranged vertically and attached to a central vertical support member.
Figure 14:
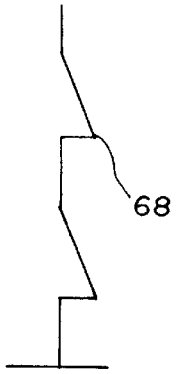
FIG. 14 is side view of a display rack similar to FIG. 12 but illustrating an embodiment without a central vertical support member.

Referring now to FIGS. 12, 13 and 14, another embodiment of a display rack is illustrated utilizing the novel keyway 58. The display rack includes a vertical support column 60 with a plurality of brackets 62 fastened to it. Each bracket has a lower connecting flange 64 that is fastened to support column 60 and also has an upper positioning flange 66 that defines the keyway 58 to receive the head of a beverage bottle. Preferably the upper positioning flange 66 is bent at an angle across keyway 58 so that a lower portion of keyway 58 extends farther away from support column than an upper portion of the keyway which causes the bottle to tilt downward when inserted in the keyway. Alternatively, the keyway can be straight and the bottle will still tilt downward because the upper positioning flange is at an angle. FIG. 14 illustrates the use of brackets 68 connected end to end to one another forming a vertical column without the use of a central vertical support member. Each of the brackets has a lower horizontally oriented connecting flange and an upper positioning flange defining a keyway for receiving the head of the beverage bottle. Each keyway receives the head and neck ring and engages the head limiting upward movement of the head while the lower connecting flange engages the shoulder limiting downward movement of the shoulder thereby allowing the body of the bottle to tilt downward.

Figure 15:
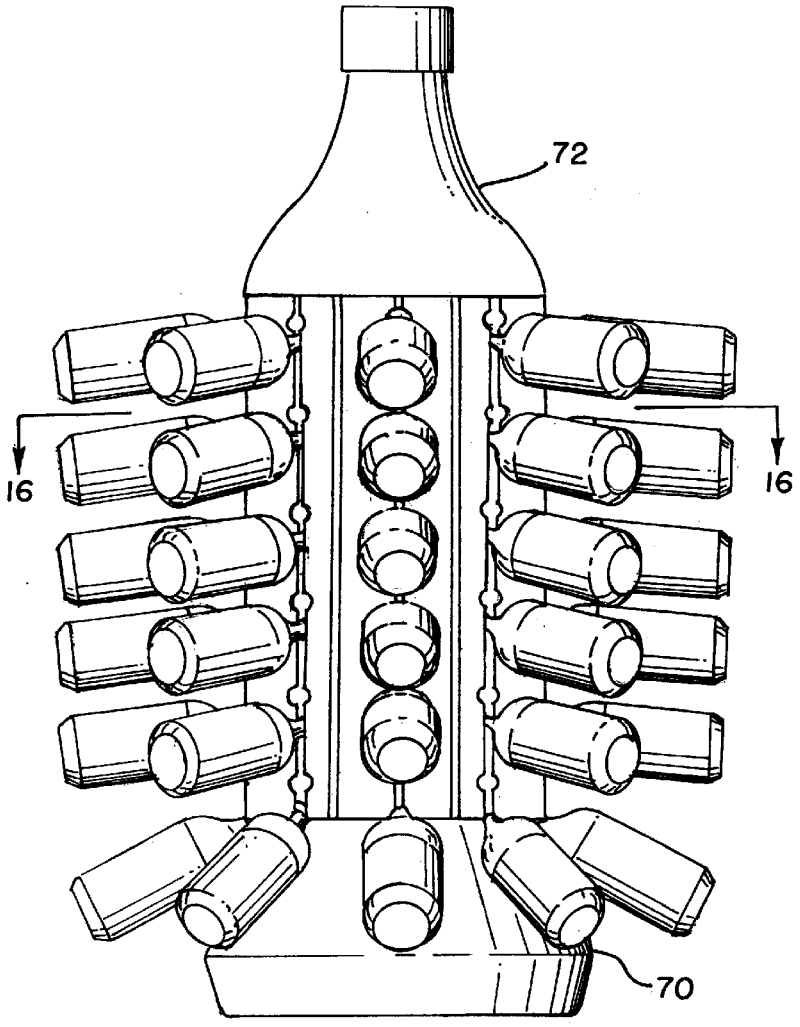
FIG. 15 is a display rack configured as a familiar beverage bottle with beverage bottles displayed about its midsection.
Figure 16:
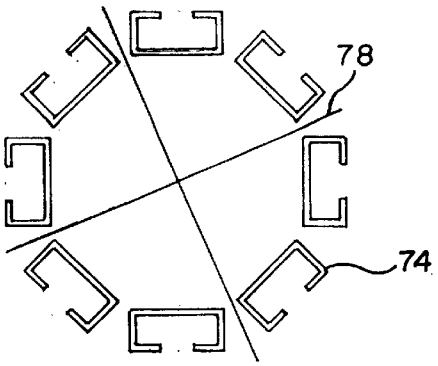
FIG. 16 is a diagrammatic sectional view taken along line 16—16 of FIG. 15 illustrating the vertical bottle holding members.
Figure 17:
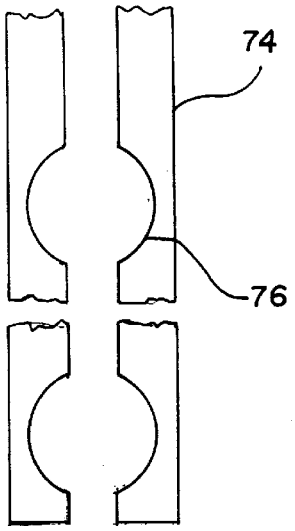
FIG. 17 illustrates a keyhole for the bottom of the vertical members of FIG. 16.

Referring now to FIGS. 15, 16 and 17, a display rack is illustrated configured as a familiar beverage bottle which has a base 70 and a removable top portion or cap 72 at the top of the rack with the mid section containing bottles of beverage to be dispensed. The mid section contains a plurality of vertical channels 74 with each channel having a longitudinal slot wide enough to receive the portion of the neck adjacent the neck ring therein. Individual bottles are inserted from the top and are removed through keyways 76 in the channel. The keyway allows the bottle to be removed because the keyway is large enough for the neck ring of the bottle to exit therethrough. The lowermost bottle hangs at an angle and preferably rests on base 70. Its neck ring engages the rear of the slot to hold it in position. The remaining bottles that are in the same slot on top of the lowermost bottle do not tilt to the same degree as the bottom most bottle. To remove the bottom most bottle, its body is raised upward and it is pulled along the slot into a keyway and pulled out of the keyway. As there are several keyways, each bottle is near a keyway. The remaining bottles will slide down the keyway when one is removed with the bottom held at an angle. When a bottle is removed, gravity causes the upper bottles to drop. For illustration purposes only, a display with eight channels 74 is shown. In actual practice, the overall dimensions of the display will dictate the number of channels. It is desirable to have enough channels to make an aesthetically appealing display without large gaps between bottles. To increase aesthetic appeal, cardboard spacers 78 can be inserted into the display between channel members 74 so that the spacers between bottles is filled with the cardboard displaying the same logo or theme as the shape of the display dictates. An advantage of this type display is that the bottle shape increases visual interest and appeal although removing a bottle requires a bit more effort than where the bottles are individually suspended where. Where space is limited a half bottle configuration can be used.

FIGS. 18 through 21 illustrate a holiday tree display rack for beverage bottles whose purpose is to increase visual appeal while placing an ample supply of product in a small space. The tree 80 is supported on a base 82 and has a main trunk or support column 84 extending upward from the base 82. A conical top 86 is attached to the top of the support 84 and preferably has a series of flashing lights to increase visual appeal. A sign holder 88 may be positioned on top of the hat to contain the logo of the beverage displayed in the tree 80. The tree 80 has beverage bottles arranged in tiers. Each tier consists of a platform 90 connected to the support column 84 and containing a number of keyways 92 along its outer periphery. A piece of wire is formed into a keyway 92 and attached to the platform 90 for suspending beverage bottles therefrom.

FIGS. 19 and 20 show a keyway 92 formed of a length of wire attached to the top side of platform 90. Keyway 92 extends above platform 90 with the top of the keyway angling away from the periphery of the platform to hold a beverage bottle at an angle and away from the platform. Alternatively, the circumferential edge of the platform could contact the body of the bottle to help support the bottle at the desired angle. The keyway can engage the neck of the bottle to hold it at the desired angle without assistance from the platform, but the platform helps prevent inadvertent dislodging of the bottle.

FIG. 21 illustrates an orientation of the keyway wherein keyway 92' does not extend above platform 90' but extends below platform 90'. Instead of inserting the bottle from beneath the keyway as in FIG. 19, the bottle is inserted from above the keyway. The top of keyway 92' is bent downward so that the top of the bottle is between the top of the key and the platform.

Figure 22:
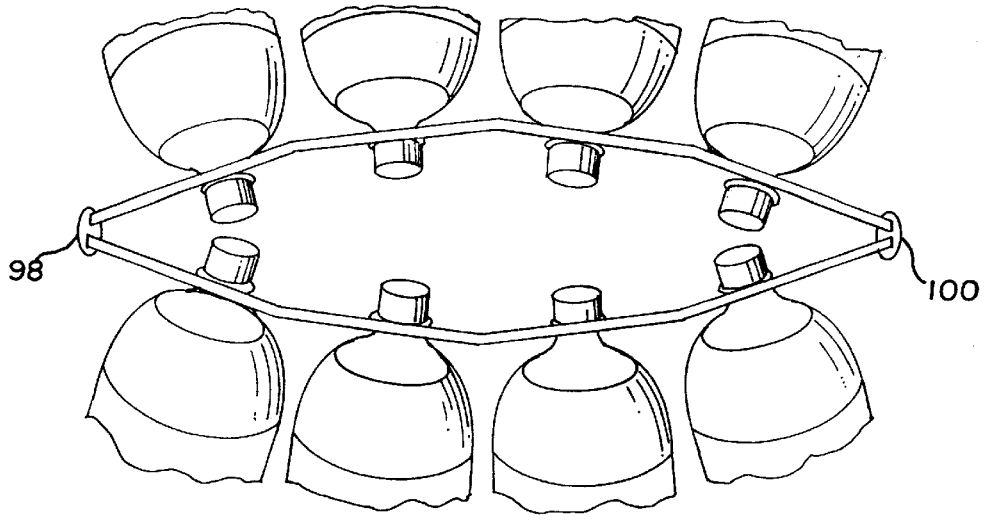
FIG. 22 is a top view of a paneled display rack similar to FIG. 9, but illustrating another embodiment with arcuate panels.

FIG. 22 illustrates a display rack with opposed panels 94, 96 with keyways for holding beverage bottles at an angle. Panels 94 and 96 are each shown composed of a number of segments to provide a panel wall that is not straight. The panel wall forms various angles giving a bowed or curved appearance similar to a bay window. The curvature increases the spacing between bottles making the bottles easier to remove one at a time. When sufficiently bowed the display rack stands on its own without anchoring making it mobile so that it is easy to change the store location. It has been found that product displays can become unnoticed by frequent shoppers when it remains exactly the same on each store visit. Therefore, mobility increases the useful life of a display because merely changing its store location breathes new life into the display making it more economical. The two sided display also has the advantage of being able to display two different brands of product or different sizes of the same product.

Panels 94 and 96 are joined at their side edges by grooved channels member 98, 100. In addition to structurally joining the panels, the channel members cover the sharp edges of the panels and can offer rounded edges which are more aesthetic. While two segmented panels are illustrated, a single circular panel could be used. A semicircular panel could also be used with or without a flat backer panel. A semicircular panel would not only spaced the bottles, but would fit flush against the end of a shelf.

Figure 23:
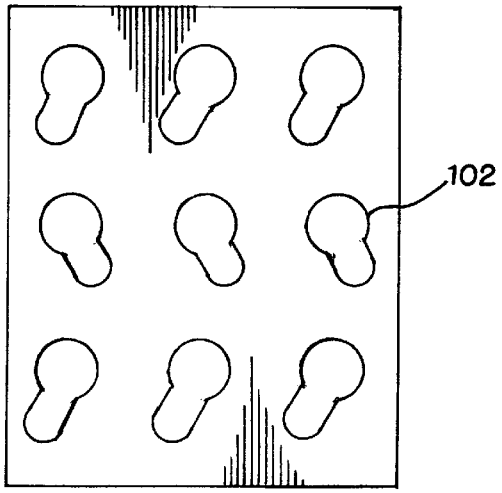
FIG. 23 is a front view of a paneled display rack similar to FIG. 9, but illustrating another embodiment with angled keyways.

Spacing between bottles can also be achieved by arranging the keyways 102 at an angle as illustrated in FIG. 23. Keyways 102 can be arranged on a flat panel as shown, or arranged on the curved panels of FIG. 22 or any other panel. In addition or alternatively, keyways can be straight and arranged in angled or spiral rows or columns to achieve spacing between bottles.

Figure 24:
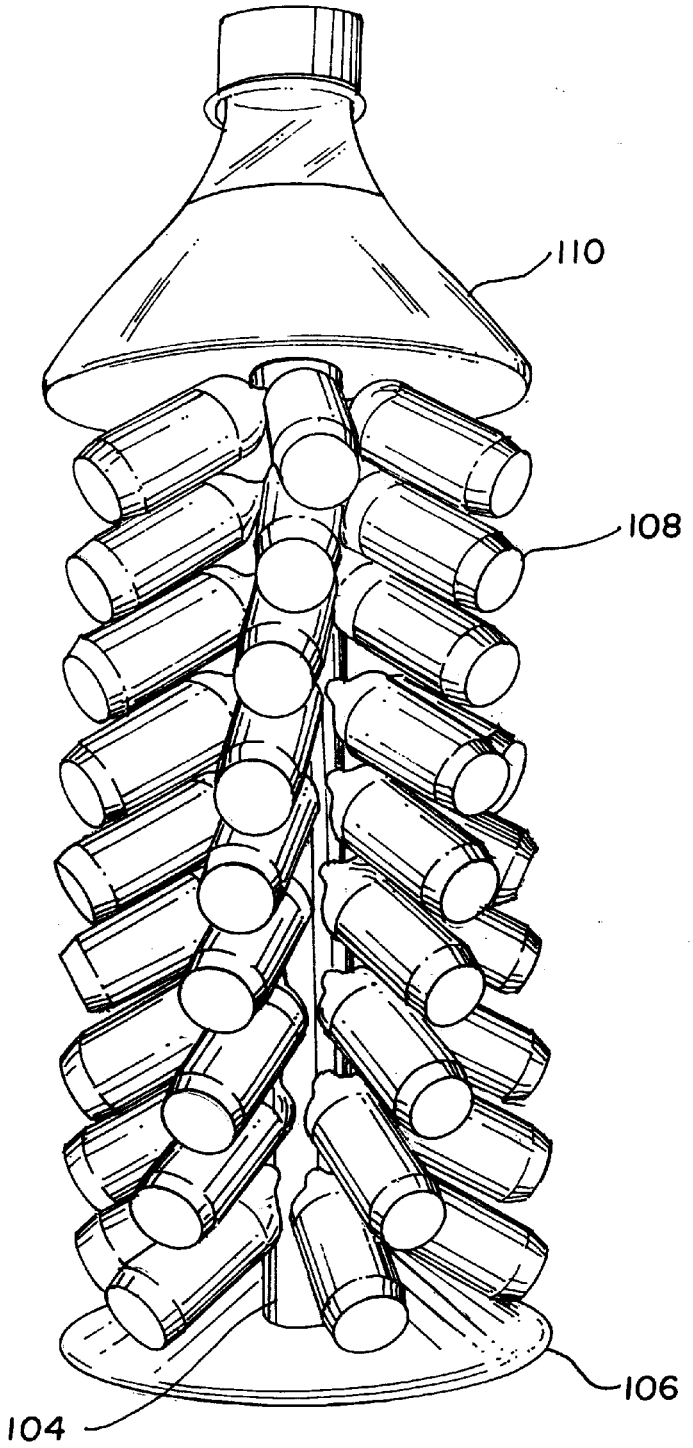
FIG. 24 is a display rack configured as a familiar beverage bottle that has bottles arranged in a spiral configuration.

FIG. 24 illustrates keyways arranged in spirals on a central support column 104 mounted on base member 106. The display rack is configured as a beverage bottle with bottles of beverage 108 arranged in a spiral configuration which increases spacing between bottles compared to straight rows or columns. A cap 110 is mounted atop the bottles 108 on the support column 104. Increased spacing between individual bottles makes it easier for a consumer to grasp a desired bottle without disturbing other bottles.

It can now be appreciated that a merchandising display rack has been presented that displays two and three liter beverage bottles, as well as other sizes, in an aesthetically appealing manner. The display rack minimizes the floor space required to display a large number of beverage bottles greater than could be displayed if the bottles were stacked vertically and only slightly less than if the bottles were stacked horizontally. The increased visual appeal occurs because the bottles are tilted downward at an angle to display not only the product but the manufacturer's own product labeling and identification. In those instances where the beverage bottle has a distinguishing configuration, the display rack allows that to be seen and appreciated. A feature of the display rack is the horizontal shelf that can be attached to the rack to display a small number of bottles vertically. The horizontal shelf has flanges that releasably engage the horizontal cross members of the rack to releasably support the shelf. The shelf is preferably movable to any location to be supported by the cross members. With such a movable shelf, product can be stacked vertically at the bottom of the shelf, at the bottom of the shelf, or any location in between. Because some beverage bottles have unique configurations that are easily recognizable, the display rack can be configured in a particular shape with bottles of beverage suspended without destroying the shape. Racks can be configured in the shape of trees or other object as desired using the keyway to hold the bottles in position.

The various configurations of the merchandising display rack are possible because of the keyway which facilitates positioning beverage bottles at an angle as a compromise between space saving horizontal stacking and visually useful vertical stacking. The keyway uses the neck ring on the bottle to prevent the bottle head from slipping through the keyway. When bent at an angle, the upper portion of the keyway holds the bottle at an angle by stopping downward pivotal motion. When made elongate with sides tapering from a large opening to a small opening, the keyway accommodates bottles of varying sizes. While two and three liter bottles are perhaps the best candidates for the keyway because they are purchased from nonrefrigerated displays, other bottle sizes are accommodated as well.

While the invention has been described with particular reference to the preferred embodiments, it will be understood by those skilled in the art that various changes may be made and equivalents may be substituted for elements of the preferred embodiments without departing from invention. It is accordingly intended that the claims shall cover all such modifications and applications as do not depart from the true spirit and scope of the invention.

What is claimed is:

1. A display rack for a plurality of beverage bottles, each of said plurality of beverage bottles having a body, a shoulder atop said body, a neck, a protruding ring about said neck, and a head atop said neck, said display rack holding said bottles by said protruding ring when inserted into said display rack, said display rack comprising:

a support base;

a left upright member attached to said support base and having front, rear, left and right vertical surfaces, said right vertical surface defining a longitudinal groove;

a right upright member attached to said support base and having front, rear, left and right vertical surfaces, said left vertical surface defining a longitudinal groove;

a plurality of bottom cross members spaced from one another and extending laterally between said left and right upright members;

a plurality of top cross members spaced from one another and extending laterally between said left and right upright members each top cross member being positioned at a higher elevation than an associated bottom cross member; and means on said plurality of top cross members for receiving and holding said plurality of beverage bottles by said protruding ring of each bottle, said means including at least one keyway on each of said top cross members for receiving and holding one of said plurality of beverage bottles, said at least one keyway limiting upward movement of said one bottle inserted therein and an associated one of said bottom cross members limiting downward movement of said one bottle thereby allowing the bottle to tilt downwardly.

2. A display rack, as set forth in claim 1, wherein said keyway abuts said neck ring to retain said bottle on said rack.

3. A display rack, as set forth in claim 2, wherein said keyway has a semicircular portion.

4. A display rack, as set forth in claim 1, including a decal panel seated in said longitudinal grooves and extending between said upright members above said top and bottom cross members.

5. A display rack, as set forth in claim 1, wherein each of said top and bottom cross members are seated in said longitudinal grooves.

6. A display rack, as set forth in claim 1, including a plurality of vertical members, each of said vertical members being positioned adjacent a respective keyway.

7. A display rack, as set forth in claim 1, wherein said upright members are attached to said support base near a midpoint of said support base.

8. A display rack, as set forth in claim 1, including a plurality of additional cross members extending laterally between said left and right upright members, and a shelf attached to said additional cross members.

9. A display rack, as set forth in claim 1, including a vertical side panel on one of said left vertical surface of said left upright member and said right vertical surface of said right upright member.

10. A display rack, as set forth in claim 9, wherein said side panel has a contour simulating a beverage bottle.

11. A display rack, comprising:

a bottom, laterally extending cross member;

a top, laterally extending cross member spaced from and above said bottom cross member;

support means for supporting said top and bottom cross members; and means on said top cross members for receiving and holding a beverage bottle, said means including at least one keyway on said top cross member for holding a beverage bottle inserted therein, said at least one keyway limiting upward movement of said bottle, and said bottom cross member limiting downward movement of said bottle thereby allowing the bottle to tilt downwardly.

12. A display rack, as set forth in claim 11, wherein said keyway abuts said neck ring to retain said bottle on said rack.

13. A display rack, as set forth in claim 12, wherein said keyway has a semicircular portion.

14. A merchandising device for beverage bottles each having a body, a shoulder atop said body, a neck, a protruding ring about said neck, and a head atop said neck, comprising a display rack for holding a plurality of said bottles in a tilted position with said head at a higher elevation than said body with upward movement of said head and downward movement of said body restrained by said display rack, said display rack comprising:

a support base;

a left upright member attached to said support base and having front, rear, left and right vertical surfaces, said right vertical surface defining a longitudinal groove;

a right upright member attached to said support base and having front, rear, left and right vertical surfaces, said left vertical surface defining a longitudinal groove;

a plurality of bottom cross members spaced from one another and extending laterally between said left and right upright members;

a plurality of top cross members spaced from one another and extending laterally between said left and right upright members, adjacent ones of said top and bottom cross members forming a pair of cross members, each pair of cross members having at least one keyway, said keyway limiting upward movement of a bottle inserted therein and said bottom cross member of said pair of cross members limiting downward movement of said bottle thereby allowing the bottle to tilt downwardly.

15. A merchandising device, as set forth in claim 14, including a decal panel seated in said longitudinal grooves and extending between said upright members above said cross members.

16. A merchandising device, as set forth in claim 14, wherein said cross members are seated in said longitudinal grooves.

17. A merchandising device, as set forth in claim 14, including a plurality of vertical members, each of said vertical members being positioned adjacent a keyway.

18. A merchandising device, as set forth in claim 14, wherein said upright members are attached to said supporting base near a midpoint of said supporting base.

* * * * *